US006417612B1

(12) United States Patent
Enomoto et al.

(10) Patent No.: US 6,417,612 B1
(45) Date of Patent: Jul. 9, 2002

(54) CATHODE-RAY TUBE AND METHOD OF MANUFACTURING THE SAME

(75) Inventors: Takashi Enomoto; Takashi Nishimura, both of Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/556,944

(22) Filed: Apr. 21, 2000

(30) Foreign Application Priority Data

Apr. 21, 1999 (JP) ..... 11-113654

(51) Int. Cl.[7] ..... H01J 29/50
(52) U.S. Cl. ..... 313/477 R; 445/45
(58) Field of Search ..... 445/22, 45; 313/477

(56) References Cited

U.S. PATENT DOCUMENTS 3,071,706 A * 1/1963 Waldorf ..... 313/477 R
4,712,038 A * 12/1987 Takenaka et al. ..... 220/2.1 A
4,714,856 A * 12/1987 Takenaka et al. ..... 220/2.1 A
4,777,407 A * 10/1988 Takenaka et al. ..... 313/2.1
4,792,720 A * 12/1988 Takenaka et al. ..... 313/477
5,365,143 A * 11/1994 Nishimura et al. ..... 313/402
6,133,675 A * 10/2000 Enomoto et al. ..... 313/2.1

FOREIGN PATENT DOCUMENTS

| | | |
|---|---|---|
| JP | 350017167 | * 2/1975 |
| JP | 61-256551 | 11/1986 |
| JP | 61-256552 | 11/1986 |
| JP | 2-51831 | 2/1990 |
| JP | 7-45215 | 2/1995 |

* cited by examiner

*Primary Examiner*—Kenneth J. Ramsey
(74) *Attorney, Agent, or Firm*—Pillsbury Winthrop LLP

(57) ABSTRACT

A vacuum envelope of a cathode-ray tube includes a panel and a funnel section opposed to the panel. The funnel section has two funnels each having a cone section. Each of the funnels is formed by cutting one side portion of a base funnel which is formed by pressing. The two funnels are joined together at sections thereof so as to form the funnel section and also joined to the panel into the vacuum envelope. A neck containing an electron gun is joined to each of the cone sections. A phosphor screen formed on the inner surface has two scanning regions which are divided scanned by electron beams emitted from the electron guns.

9 Claims, 6 Drawing Sheets

CATHODE-RAY TUBE AND METHOD OF MANUFACTURING THE SAME

CROSS-REFERENCE TO RELATED APPLICATIONS

This application is based upon and claims the benefit of priority from the prior Japanese Patent Application No. 11-113654, filed Apr. 21, 1999, the entire contents of which are incorporated herein by reference.

BACKGROUND OF THE INVENTION

The present invention relates to a cathode-ray tube and a method of manufacturing the same and, more specifically, to a cathode-ray tube of divided scanning a phosphor screen with electron beams emitted from a plurality of electron guns and a method for manufacturing the same.

In recent years, various discussions have been made on a high-resolution cathode-ray tube designed for high-definition broadcasting or having a large screen. For providing a cathode-ray tube with a high resolution, the diameter of a spot of an electron beam on the phosphor screen must be minimized. In contrast, the structures of electrodes constituting an electron gun have been improved or the electron gun itself has been remodeled to have a larger aperture or a larger length. However, no fruit has been born yet.

As the cathode-ray tube is made large in size, the distance from the electron gun to the phosphor screen becomes long, and the power of an electronic lens becomes too high. This is the most critical reason why no fruit has been born yet. Consequently, for realizing a high resolution, the distance from the electron gun to the phosphor screen (depth) must be decreased. At this time, if an electron beam is deflected at a wide angle, a difference in magnification between the center of the screen and the periphery thereof increases. This is therefore unacceptable in terms of the high resolution.

According to a conventionally adopted method, a plurality of electron guns and a plurality of deflection yokes are employed in order to divided scan a plurality of regions defined of a single phosphor screen. Images rendered in the regions are joined to produce a large image. For example, Jpn. Pat. Appln. KOKAI Publication Nos. 7-45215 and 2-51831 have disclosed cathode-ray tubes for joining two images to produce a large picture. Moreover, Japanese Unexamined Patent Publications Nods. 61-256552 and 61-256551 have proposed cathode-ray tubes for joining a larger number of images to produce a large picture.

This kind of cathode-ray tube has a vacuum envelope having a panel, a funnel including two corn portions and coupled to the panel, and two necks coupled to the funnel. A deflection unit is mounted on the external surface of each corn portion. An electron gun is arranged in each neck.

In the cathode-ray tube having the above components, electron beams emitted from the electron gun are deflected due to magnetic fields generated by the deflection units. A phosphor screen formed on the inner surface of the panel has two regions corresponding to the electron guns and the two regions are divided scanned by the electron beams. Sub-images rendered on the phosphor screen are joined by controlling signals to be applied to the electron guns and deflection units. Consequently, one large image having neither a break nor overlap is produced over the whole surface of the phosphor screen.

The panel of the cathode-ray tube described above is formed by pressing using a forming mold by the same method as that of manufacturing a conventional cathode-ray tube. More specifically, the forming mold has a bottom and a shell ring provided detachable from the bottom, and a plunger can be inserted into the cavities of the bottom and shell ring.

In forming the panel, a glass gob (high-temperature glass gob) is supplied to the bottom to fix the shell ring and push the plunger into the mold. The panel so formed is cooled and then the shell ring is detached from the bottom, thereby removing a molding product therefrom.

However, upon manufacturing the cathode-ray tube described above, the funnels may be broken in the cooling step after pressing, due to the difference between thermal expansion coefficient of materials of the bottom and the glass. Thus, the funnels of the cathode-ray tube cannot be formed by pressing using the same method as that of forming a conventional cathode-ray tube.

BRIEF SUMMARY OF THE INVENTION

The present invention has been developed in consideration of the above situation and its object is to provide a cathode-ray tube wherein a phosphor screen is divided scanned with electron beams emitted from a plurality of electron guns, and wherein funnels can be formed easily and inexpensively making use of a conventional pressing process, and a method for manufacturing the same cathode-ray tube.

To attain the above object, a cathode-ray tube according to the present invention comprises:

- a vacuum envelope including a glass panel having a phosphor screen on an inner surface thereof, a funnel section having a plurality of cone sections and joined to the glass panel, and a plurality of necks extending from the cone sections respectively;
- a plurality of deflection devices mounted outside the cone sections; and
- a plurality of electron guns arranged in the necks, respectively, for divided scanning a plurality of scanning regions of the phosphor screen with electron beams,
- wherein the funnel section includes a plurality of funnels each formed by cutting at least one side portion of a base funnel which is so formed as to have one cone section, and the funnels have respective sections joined to each other.

A method for manufacturing a cathode-ray tube according to the present invention, comprises a vacuum envelope including a glass panel having a phosphor screen on an inner surface thereof, a funnel section having a plurality of cone sections and joined to the glass panel, and a plurality of necks extending from the cone sections respectively; a plurality of deflection devices mounted outside the cone sections; and a plurality of electron guns provided in the necks, respectively, for divided scanning a plurality of scanning regions of the phosphor screen with electron beams, the method comprising the steps of:

- preparing a plurality of base funnels;
- cutting at least one side portion of each of the base funnels to form a plurality of funnels; and
- joining sections of the funnels to each other and joining the funnels to the glass panel to form the vacuum envelope.

According to the cathode-ray tube so constituted and the method for manufacturing the same, a plurality of glass funnels are each formed by cutting at least one side portion of a base funnel formed by pressing and the funnels are joined together into a funnel section. Therefore, the cathode-ray tube can be manufactured easily and inexpensively and the method for manufacturing the same can be provided.

In other words, each of the glass funnels has a cone section and is formed by cutting part of a funnel having the same shape as that of a funnel of a conventional cathode-ray tube. The glass funnels can thus be formed easily by pressing by the same method and using the same forming mold as in a conventional cathode-ray tube. The existent glass cutting technique can be applied to cutting of the funnels, and the conventional sealing process can be used for joining the funnels together. Consequently, there can be provided with a cathode-ray tube capable of being manufactured easily and inexpensively making use of the conventional pressing process, and a method for manufacturing the same cathode-ray tube.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
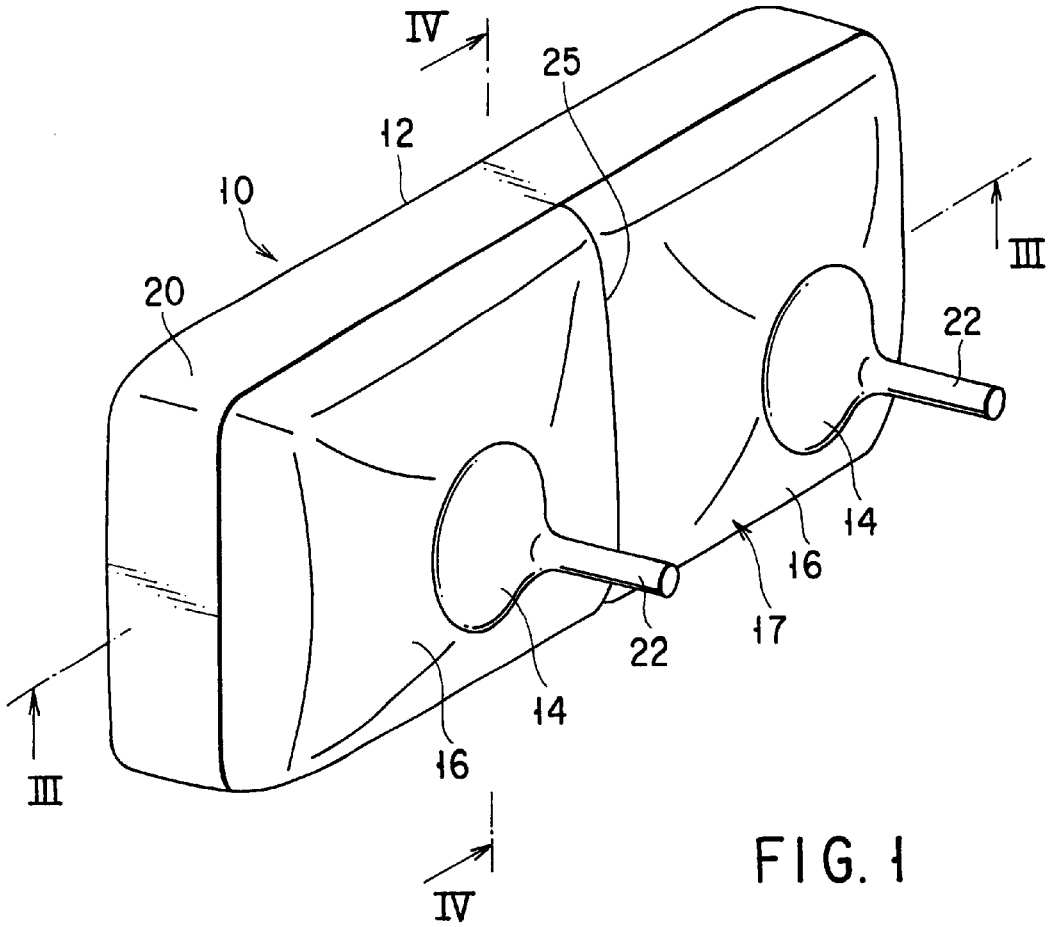
FIG. 1 is a perspective view of the back of a cathode-ray tube according to a first embodiment of the present invention.

A cathode-ray tube according to each embodiment of the present invention will now be described in detail with reference to the accompanying drawings.

As illustrated in FIGS. 1 to 4, a cathode-ray tube according to a first embodiment of the present invention includes a vacuum envelope 10 which has a panel 12 made of glass and a funnel section 17 joined to the panel. The funnel section 17 is constituted by joining two glass funnels 16 together. Each of the glass funnels 16 has a funnel-shaped cone section 14.

The panel 12 includes a substantially rectangular face plate 18 having a rectangular phosphor screen 15 on its inner surface and a skirt section 20 standing on the periphery of the face plate. The face plate 18 and skirt section 20 are formed integrally as one piece. The panel 12 has long and short axes X and Y passing through the center of the panel and intersecting at right angles.

As will be described later, the funnels 16 are each formed by cutting one side portion of a base funnel which is formed in a symmetrical shape by pressing, and the sections of the two funnels 16 are joined together into the funnel section 17. The end face of the skirt section 20 serves as a sealing face to which the funnel section 17 is joined.

A neck 22 is connected to the cone section 14 of each of the funnels 16, and an electron gun 24 is provided in the neck 22. Further, a deflection device 28 is mounted outside the cone section 14 in order to deflect an electron beam emitted from the electron gun 24.

Figure 2:
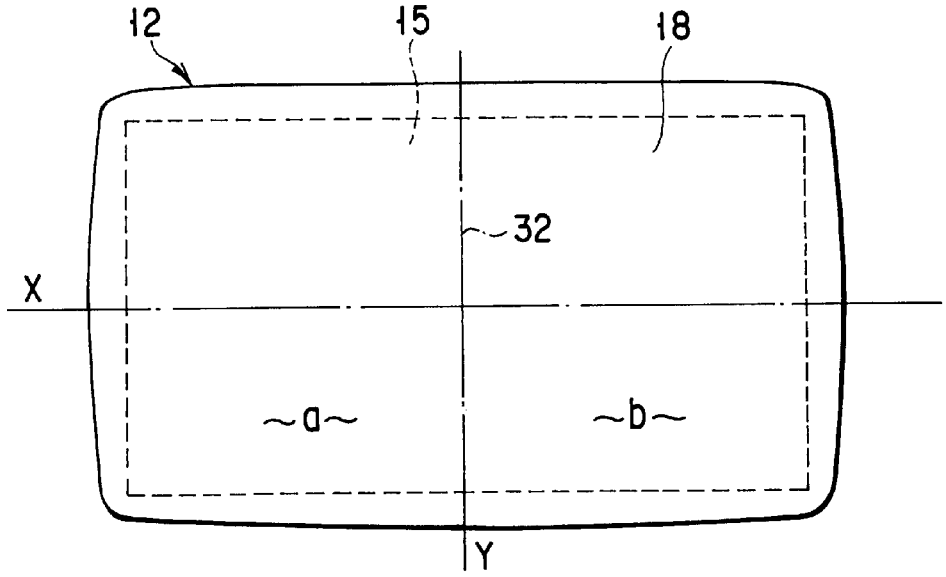
FIG. 2 is a front view of the cathode-ray tube shown in FIG. 1.
Figure 3:
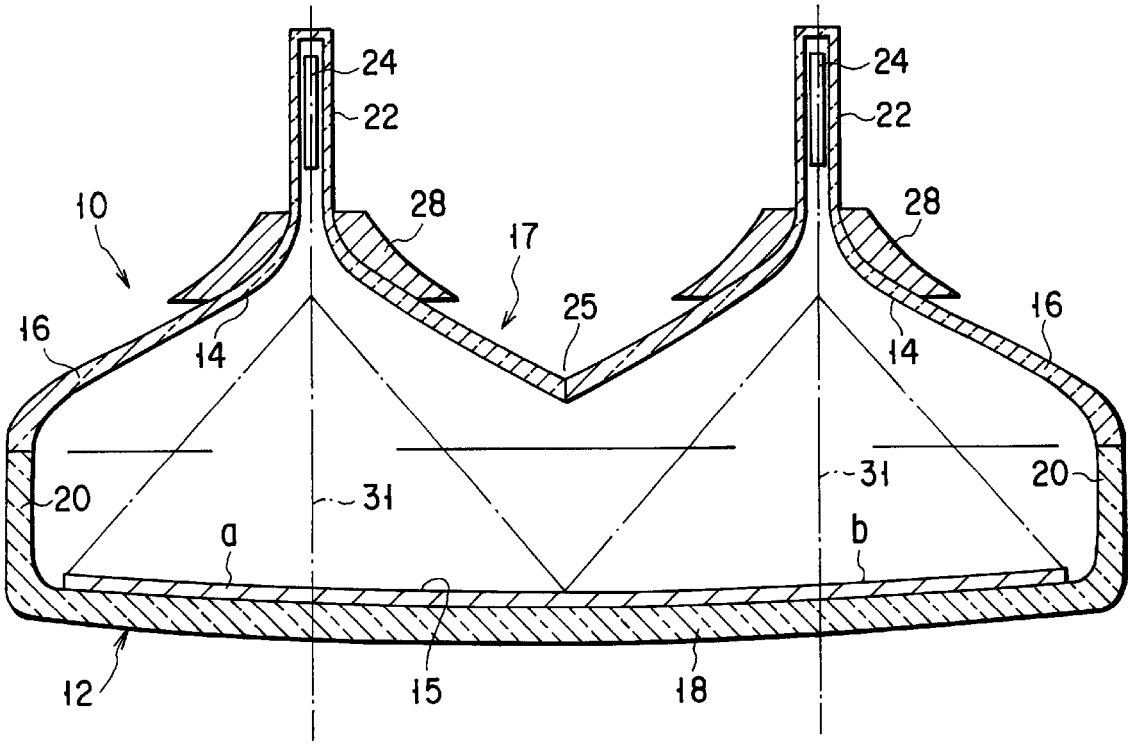
FIG. 3 is a cross-sectional view of the cathode-ray tube taken along line III—III of FIG. 1.
Figure 4:
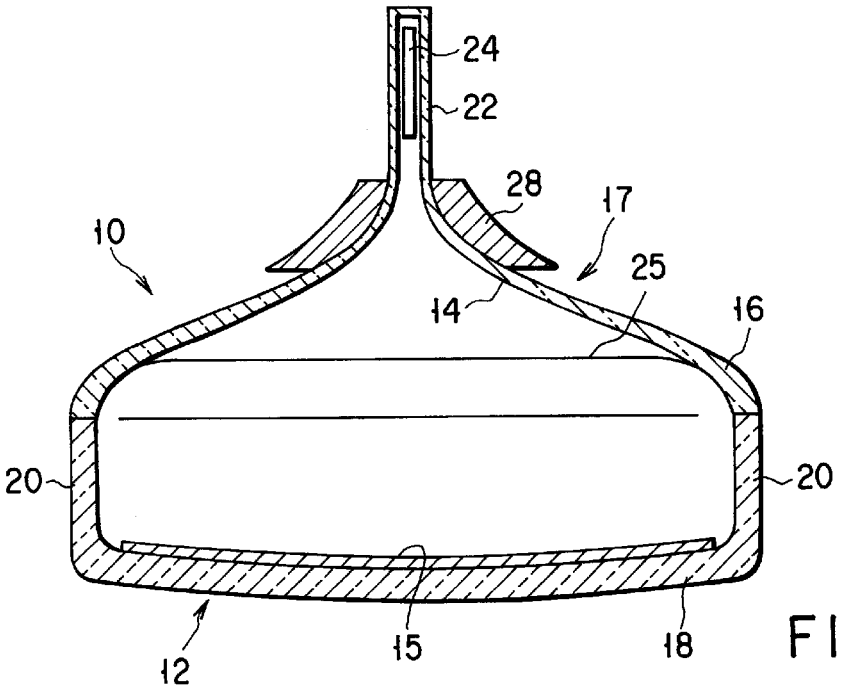
FIG. 4 is a cross-sectional view of the cathode-ray tube taken along line IV—IV of FIG. 1.

As shown in FIG. 2, the phosphor screen 15 has two scanning regions a and b defined side by side along the long axis X with the short axis Y as a boundary 32. These regions have the same shape and are symmetrical with regard to the short axes X and Y. The two funnels 16 and electron guns 24 are arranged opposite to their respective scanning regions a and b, and a junction 25 between the two funnels 16 is located opposite to the boundary 32 between the scanning regions a and b. Each neck 22 and each electron gun 24 are arranged on a normal 31 passing through the center of their corresponding scanning region. The two necks 22 thus extend substantially in parallel with each other.

According to the cathode-ray tube having the above structure, electron beams emitted from the two electron guns 24 are deflected by magnetic fields generated from their corresponding deflection devices 28, and the scanning regions a and b of the phosphor screen 15 are scanned horizontally and vertically with the deflected beams to form an image (or a raster) on each of the scanning regions. Since the size of the raster is equal to that of its corresponding scanning region, the rasters join together sexlessly and smoothly to thereby obtain one large raster. In this case, two necks 22 are almost parallel with each other as described above, the deflection devices 28 can easily be mounted and adjusted.

Figure 5:
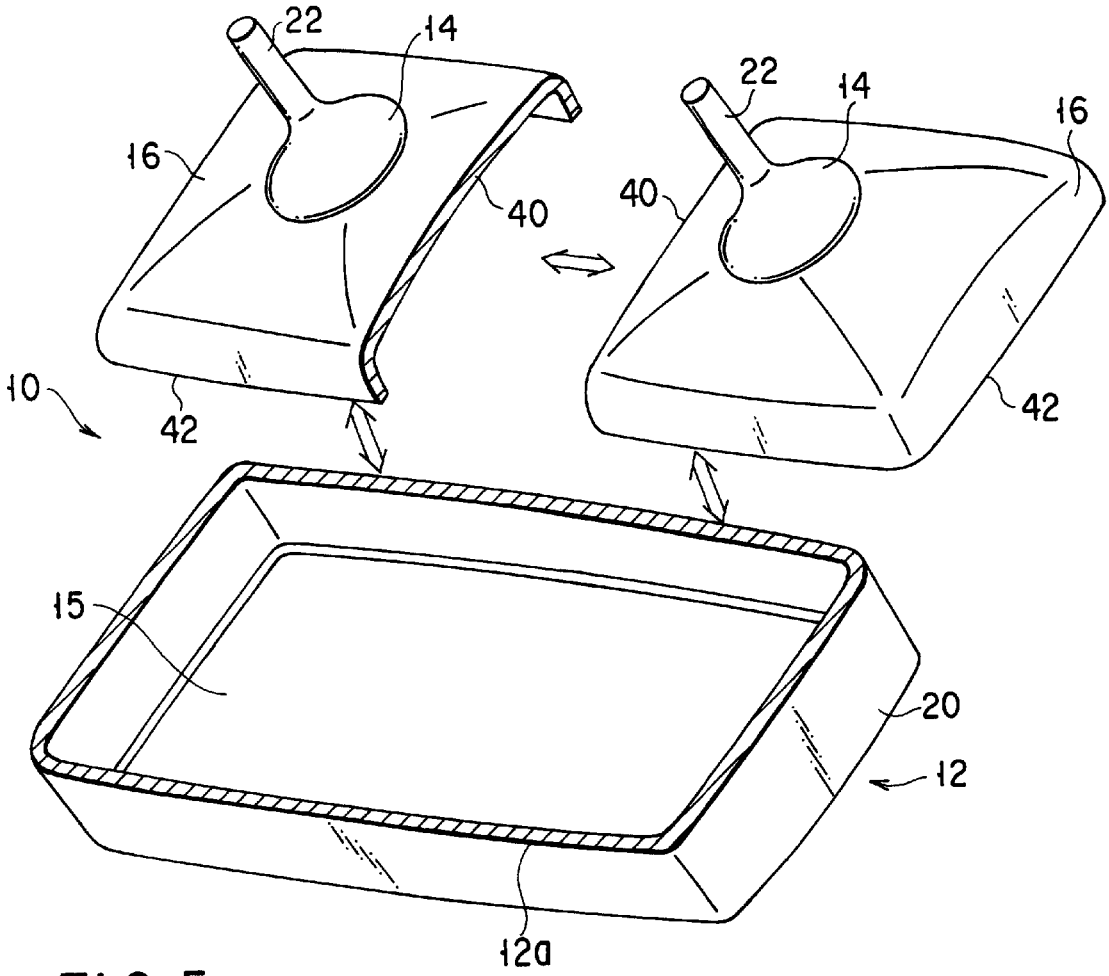
FIG. 5 is an exploded perspective view of constituting elements of a vacuum envelope of the cathode-ray tube.

A method of manufacturing a cathode-ray tube having the above-mentioned structure will now be described. As illustrated in FIG. 5, a panel 12 made of glass, two funnels 16 each having a cone section 14, and two necks 22 are prepared as constituting members of a vacuum envelope 10. The panel 12 is formed by pressing by using a forming mold with the same manner as in a conventional cathode-ray tube. The end face of a skirt section 20 serves as a sealing face 12*a* to which the funnels 16 are to be joined, and the sealing face 12*a* is flattened. The necks 22 are shaped by a tube drawer, with the same manner as in a conventional cathode-ray tube.

Figure 6:
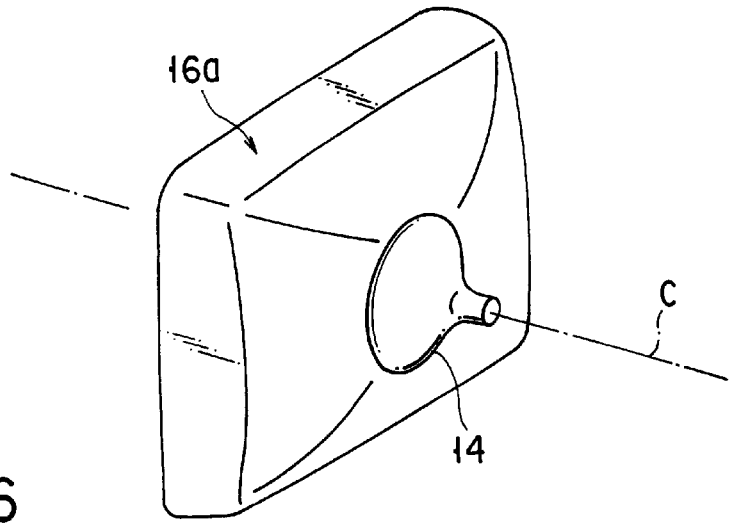
FIG. 6 is a perspective view showing a base funnel formed by pressing.

Each of the funnels 16 is formed by pressing by using a forming mold with the same manner as in a conventional cathode-ray tube. Then, the molded funnel 16 is cut out at its one side portion. Specifically, as shown in FIG. 6, first, a base funnel 16*a* which has a symmetrical shape with respect to the center axis C is formed by pressing. A large-diameter portion of the base funnel 16*a* has a substantially rectangular cross section.

Figure 7A:
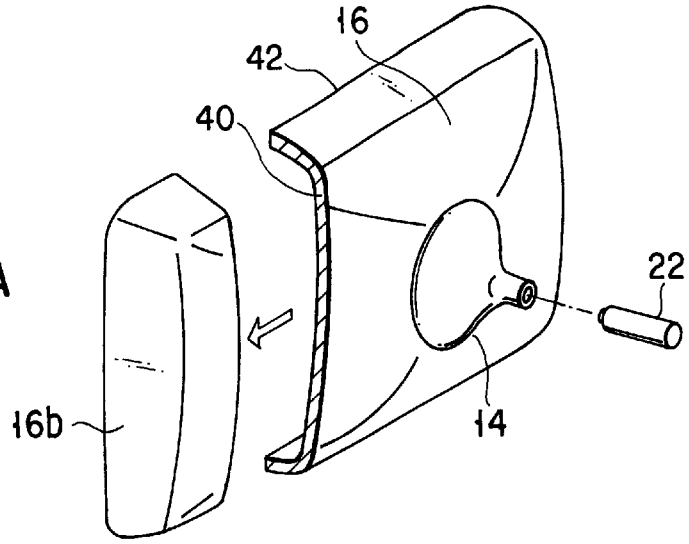
FIG. 7A is a perspective view showing a process of forming a funnel by cutting the base funnel.
Figure 7B:
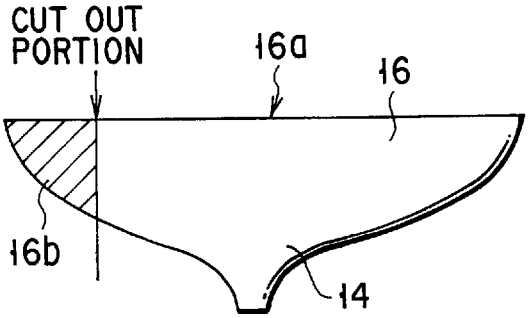
FIG. 7B is a side view of a cutout portion of the base funnel.
Figure 7C:
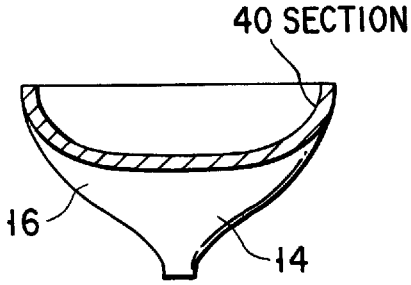
FIG. 7C is a side view of a section of the base funnel.

A portion accumulated at the end of the cone section 14 is removed and, as shown in FIGS. 7A to 7C, one side portion 16*b* of the base funnel 16*a* is cut out along a section 40 which is substantially in parallel with one side of the base funnel 16*a*, thereby obtaining the funnel 16 having the section 40 and shaped asymmetrically. The end face of the large-diameter portion of each funnel 16 functions as a sealing face 42 to be joined to the panel 12, and the sealing face 42 is flattened. The section 40 of each funnel 16 functions as a surface to be joined to the section of another funnel, and this surface is flattened.

The vacuum envelope 10 is assembled with the above constituting members through the following process. First, one end of the cone section 14 of each funnel 16 is cut out, and the neck 22 is welded to the end of the cone section by means of a burner. Then, as shown in FIG. 5, a phosphor is applied to the inner surface of the panel 12, and the panel 12 is mounted on a sealing jig (sealing frame), not shown, with its sealing face 12*a* up.

Subsequently, frit glass is applied to the sealing face 12*a* of the panel 12, the sealing faces 42 of the funnels 16, and the sections 40 thereof and then dried. After that, the two funnels 16 to which the necks 22 are welded are placed on the sealing face 12*a* of the panel 12 with their sealing faces 42 down and, at the same time, the sections 40 of the funnels 16 confront each other. In this state, the panel 12 and funnels 16 are aligned with a predetermined position by an alignment section (pad) of the sealing frame.

Thereafter, the panel 12 and funnels 16 are heated through a sealing furnace to seal the funnels 16 with each other and also seal the panel 12 and the funnels 16 with each other. An electron gun 24 is sealed in each of the necks 22 of an envelope so formed, and the envelope is exhausted to obtain the vacuum envelope 10.

Then, a deflection device 28 is mounted on the cone section 14 of each of the funnels 16 and their positions are adjusted, thereby completing the cathode-ray tube.

According to the cathode-ray tube so constituted, each glass funnel 16 having a funnel-shaped cone section 14 is formed by cutting one side portion of a base funnel 16*a* which is pressed so as to have the same shape as that of a conventional cathode-ray tube; therefore, the funnels 16 can easily be formed by pressing using the existing forming mold through the same process as that of the conventional one.

Since the base funnel can be cut by the existing glass cutting technique and the funnels 16 are sealed with each other using frit glass, the same sealing process as that of a conventional cathode-ray tube can be executed. Consequently, the funnels 16 and the vacuum envelope 10 having them can be formed easily and inexpensively utilizing the conventional pressing technique.

In the foregoing embodiment, the funnel section 17 is constituted of two glass funnels 16 each having a funnel-shaped cone section 14. The present invention is not limited to this funnel section. The funnel section can be constituted of three or more glass funnels.

Figure 8:
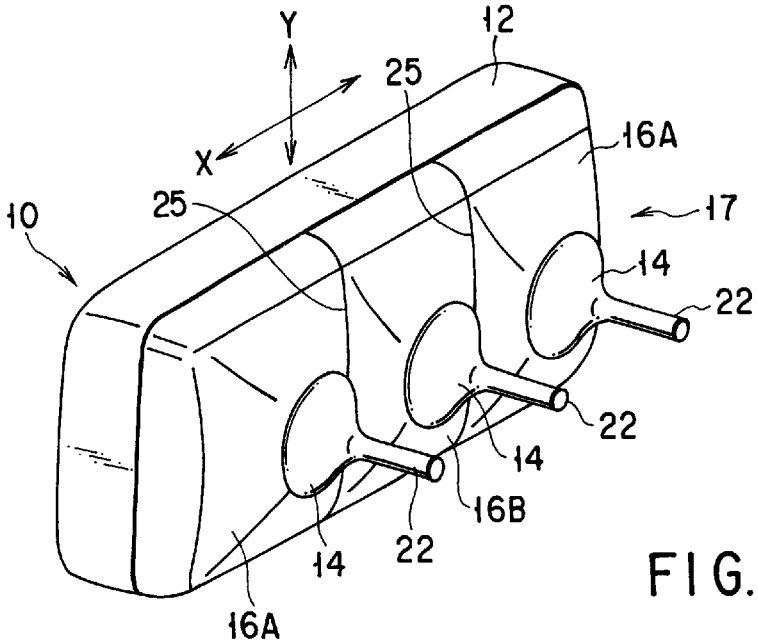
FIG. 8 is a perspective view of the back of a cathode-ray tube according to a second embodiment of the present invention.

FIG. 8 illustrates a cathode-ray tube according to a second embodiment of the present invention. The cathode-ray tube includes a vacuum envelope 10, and the vacuum envelope has a glass-made, rectangular panel 12 and a funnel section 17 joined to the panel. The funnel section 17 is constituted by joining three glass funnels together. The three glass funnels include two glass funnels 16A (first funnels) each having a cone section 14, and one glass funnel 16B (second funnel) also having a cone section 14.

The panel 12 has long and short axes X and Y passing through the center thereof and intersecting at right angles, and a rectangular phosphor screen is formed on the inner surface of the panel 12. A neck 22 is connected to the cone section 14 of each of the funnels 16A and 16B, and an electron gun is arranged in the neck 22. Further, on the outside of each cone section 14 is mounted a deflection device, not shown, for deflecting an electron beam emitted from the electron gun. The three funnels 16A and 16B are arranged along the long axis X.

As will be described later, the funnels 16A are each formed by cutting one side portion of a base funnel which is formed in a symmetrical shape by pressing, while the funnel 16B is formed by cutting opposing two side portions of a base funnel which is formed in a symmetrical shape by pressing. The sections of these three funnels 16A and 16B are joined together, thereby constituting the funnel section 17.

In the second embodiment, the phosphor screen has three scanning regions arranged side by side along the long axis X, and the three funnels 16A and 16B and the electron guns are opposed to their respective scanning regions. A junction 25 between each of the funnels 16A and the funnel 16B is opposed to its corresponding boundary between the scanning regions.

According to the cathode-ray tube having the above structure, electron beams emitted from the three electron guns are deflected by magnetic fields generated from their corresponding deflection devices, and the three scanning regions of the phosphor screen are divided scanned horizontally and vertically with the deflected beams to thereby producing a raster on each of the scanning regions. The size of the raster is equal to that of its corresponding scanning region, and the rasters join together sexlessly and smoothly to thereby obtain one large raster.

Figure 9:
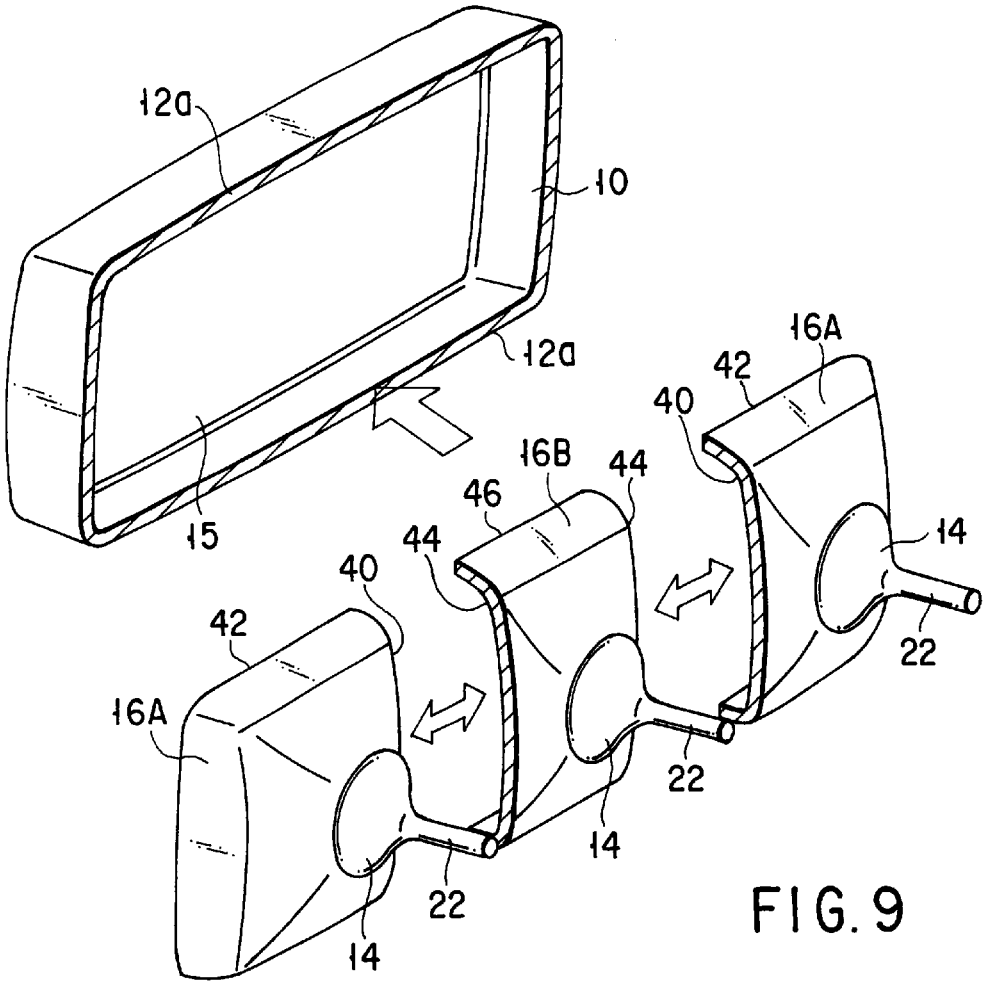
FIG. 9 is an exploded perspective view of constituting elements of a vacuum envelope of the cathode-ray tube shown in FIG. 8.

According to a method of manufacturing a cathode-ray tube so constituted, as illustrated in FIG. 9, a glass-made panel 12, three funnels 16A and 16B each having a cone section 14, and three necks 22 are prepared as constituting members of a vacuum envelope 10. As in a conventional cathode-ray tube, the panel 12 is formed by pressing by using a forming mold. The end face of a skirt section of the panel is formed as a sealing face 12*a* to which the funnels 16A and 16B are to be joined, and the sealing face 12*a* is flattened. The necks 12 are shaped by a tube drawer, as those of a conventional cathode-ray tube.

The funnels 16A and 16B are each formed by cutting part of a base funnel which is formed by pressing using a forming mold. In other words, as in the foregoing first embodiment, the base funnel (see FIG. 6) is formed by pressing so as to have a symmetrical shape with respect to the center axis. A large-diameter portion of the base funnel has a substantially rectangular cross section.

Figure 10:
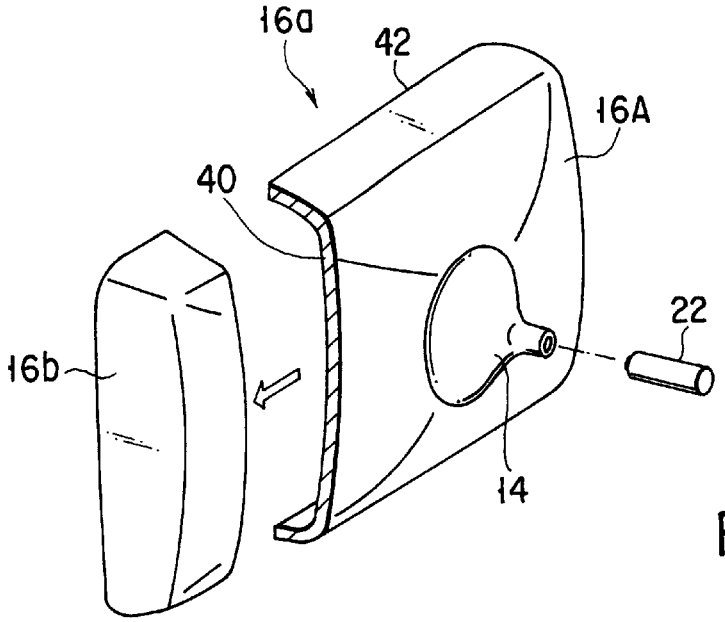
FIG. 10 is a perspective view showing a process of forming a funnel by cutting a base funnel shaped by pressing.
Figure 12A:
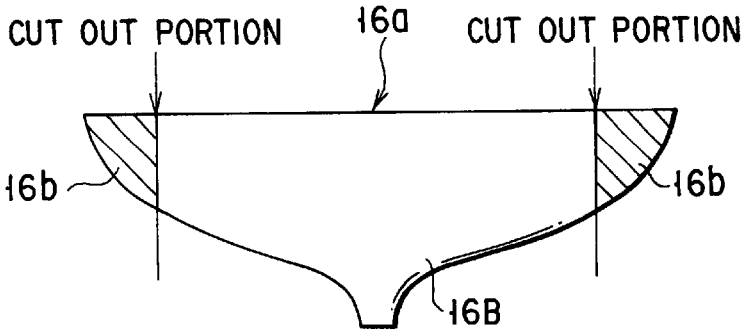
FIG. 12A is a view schematically showing a process of forming a second funnel by cutting the base funnel.
Figure 12B:
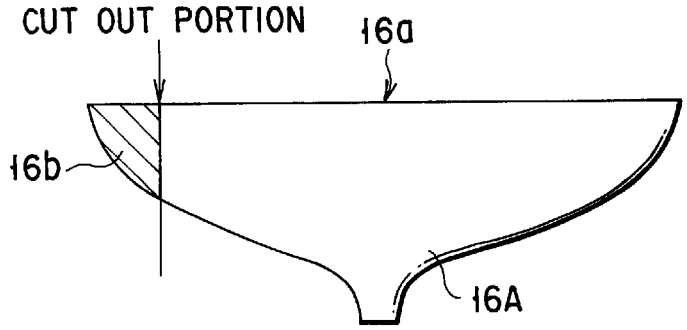
FIG. 12B is a view schematically showing a process of forming a first funnel by cutting the base funnel.
Figure 12C:
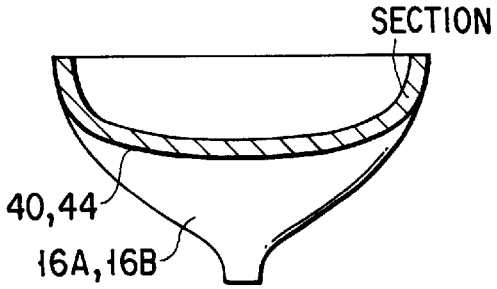
FIG. 12C is a side view of a section of the base funnel.

In manufacturing the funnels 16A, an accumulated portion of a base funnel 16*a* is cut out of the cone section 14 and, as shown in FIGS. 10, 12B and 12C, one side portion 16*b* of the base funnel 16*a* is cut along a section 40 which is substantially in parallel with one side of the base funnel 16*a* and removed, thereby completing the funnel 16A having a section 40 and an asymmetrical shape. The end face of the large-diameter portion of each funnel 16A functions as a sealing-face 42 to be joined to the panel 12, and the sealing face 42 is flattened. The section 40 of each funnel 16A functions as a surface to be joined to the section of another funnel, and this surface is flattened.

Figure 11:
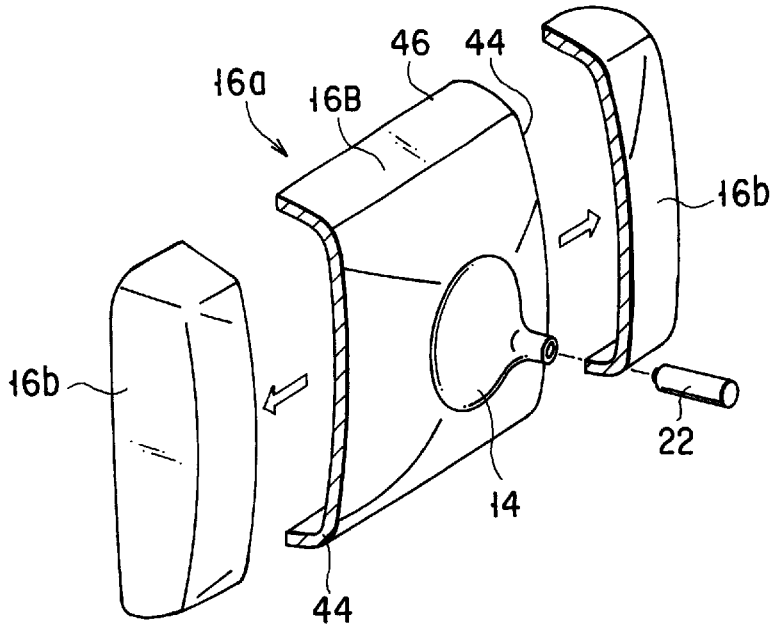
FIG. 11 is a perspective view showing a process of forming another funnel by cutting the base funnel.

In forming the funnel 16B, an accumulated portion of a base funnel 16*a* is cut out of the cone section 14 and, as shown in FIGS. 11, 12A and 12C, opposing two side portions 16*b* of the base funnel 16*a* are cut along sections 44 which are substantially in parallel with two sides of the base funnel 16*a* and removed, thereby completing the funnel 16B having a pair of sections 44 opposed to each other. The end face of the large-diameter portion of the funnel 16B serves as a sealing face 46 to be joined to the panel 12, and the sealing face 46 is flattened. Each of the sections 44 of the funnel 16B functions as a surface to be joined to the section 40 of the funnel 16A, and this surface is flattened.

The vacuum envelope 10 is assembled with the above constituting members through the following process. First, an end portion is cut out of the cone section 14 of each of the funnels 16A and 16B, and the necks 22 are welded to their respective end portions of the corn sections using a burner. Then, as shown in FIG. 9, a phosphor is applied to the inner surface of the panel 12, and the panel 12 is mounted on a sealing jig (sealing frame), not shown, with its sealing face 12*a* up. The funnels 16A and 16*b* are arranged above the panel 12. At this time, the funnels 16A are arranged on both sides of the funnel 16B, and the sections 44 of the funnel 16B are opposed to the section 40 of each of the funnels 16A.

Subsequently, frit glass is applied to the sealing face 12*a* of the panel 12, the sealing faces 42 and 46 of the funnels 16A and 16B, and the sections 40 and 44 thereof and then dried. After that, the three funnels 16A and 16B to which the necks 22 are welded are placed on the sealing face 12*a* with their sealing faces 42 and 46 down and, at the same time, the sections 40 and 44 of the funnels confront each other. In this state, the panel 12 and funnels 16A and 16B are aligned with a predetermined position by an alignment section (pad) of the sealing frame.

Thereafter, the panel 12 and the funnels 16A and 16B are heated through a sealing furnace to seal the funnels 16A and 16B with each other and also seal the panel 12 and the funnels 16A and 16B with each other. An electron gun 24 is sealed in each of the necks 22 of an envelope so formed, and the envelope is exhausted to form the vacuum envelope 10. After that, a deflection device is mounted on the cone section 14 of each of the funnels 16A and 16B and their positions are adjusted, thereby completing the cathode-ray tube.

With the foregoing second embodiment, too, the funnels can be formed easily and inexpensively through the conventional pressing process and using the existent forming mold and so can be the vacuum envelope through the conventional sealing process. Consequently, a cathode-ray tube having a plurality of funnels can be manufactured easily and inexpensively.

In the first and second embodiments described above, the panel sealing face and the funnel sections are sealed with a frit glass. The present invention is not limited to this sealing. They can be sealed with any other means, such as burner heating and high-frequency heating.

The base funnel is not limited to a shape which is symmetrical with respect to its center axis. For example, it can be shaped symmetrically with respect to the x-axis or formed in various shapes.

The present invention is not limited to a cathode-ray tube having no shadow masks but can be applied to a color cathode-ray tube having a shadow mask, a beam-index type cathode-ray tube, and the like. The number of scanning regions of a phosphor screen or the number of funnels is not limited to two or three. These numbers can be increased if necessary.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube comprising:

a vacuum envelope including a glass panel having a phosphor screen on an inner surface thereof, a funnel section having a plurality of cone sections and joined to the glass panel, and a plurality of necks extending from the cone sections respectively;

a plurality of deflection devices mounted outside the respective cone sections; and a plurality of electron guns arranged in the necks, respectively, for divided scanning a plurality of scanning regions of the phosphor screen with electron beams, wherein the funnel section includes a plurality of funnels each formed by cutting at least one side portion of a base funnel which is so formed as to have one cone section, and the funnels have respective sections joined to each other.

2. A cathode-ray tube according to claim 1, wherein the funnel section includes two funnels having substantially same shapes, and the funnels are each formed by cutting one side portion of a base funnel and joined together at sections thereof and joined to the glass panel.

3. A cathode-ray tube according to claim 1, wherein the funnel section includes two first funnels each formed by cutting one side portion of a base funnel and having substantially same shapes, and a second funnel formed by cutting opposing two side portions of a base funnel substantially in parallel with each other, and the second funnel is interposed between the first funnels and sections of the second funnel are joined to respective sections of the first funnels.

4. A method for manufacturing a cathode-ray tube comprising a vacuum envelope including a glass panel having a phosphor screen on an inner surface thereof, a funnel section having a plurality of cone sections and joined to the glass panel, and a plurality of necks extending from the cone sections respectively; a plurality of deflection devices mounted outside the cone sections; and a plurality of electron guns arranged in the respective necks, for divided scanning a plurality of scanning regions of the phosphor screen with electron beams, the method comprising the steps of:

preparing a plurality of base funnels;

cutting at least one side portion of each of the base funnels to form a plurality of funnels; and joining sections of the funnels to each other to form the funnel section, and joining the funnels to the glass panel to form the vacuum envelope.

5. A method according to claim 4, which comprises the steps of:

preparing two funnels each obtained by cutting one side portion of a base funnel and having substantially same shapes, joining sections of the two funnels together to form the funnel section, and joining each of the funnels to the glass panel.

6. A method according to claim 4, which further comprises the steps of:

preparing two first funnels each formed by cutting one side portion of a base funnel and having substantially same shapes and a second funnel formed by cutting opposing two side portions of a base funnel substantially in parallel with each other;

arranging the second funnel between the two first funnels; and joining both sections of the second funnel to corresponding sections of the first funnels, thereby forming the funnel section.

7. A method according to claim 4, wherein the sections of the funnels are joined to each other with frit glass, and the funnels and the glass panel are joined to each other with frit glass.

8. A method according to claim 4, wherein the sections of the funnels are welded to each other by a burner, and the funnels and the glass panel are welded to each other by a burner.

9. A method according to claim 4, wherein the base funnels are each formed by pressing.

* * * * *